US008246919B2

(12) United States Patent
Herchenbach et al.

(10) Patent No.: US 8,246,919 B2
(45) Date of Patent: Aug. 21, 2012

(54) SPECIMEN SAMPLE RACK

(75) Inventors: Stephen L. Herchenbach, Antioch, IL (US); E. Kim Pavlovic, Zion, IL (US)

(73) Assignee: Abbott Laboratories, Des Plaines, IL (US)

( * ) Notice: Subject to any disclaimer, the term of this patent is extended or adjusted under 35 U.S.C. 154(b) by 1024 days.

(21) Appl. No.: 11/524,861

(22) Filed: Sep. 21, 2006

(65) Prior Publication Data

US 2008/0075634 A1 Mar. 27, 2008

(51) Int. Cl.
*B01L 9/06* (2006.01)

(52) U.S. Cl. ..... 422/562; 422/300; 211/71.01; 435/809

(58) Field of Classification Search ..... 422/300, 422/560–562, 564; 211/71.01; 435/809
See application file for complete search history.

(56) References Cited

U.S. PATENT DOCUMENTS 4,124,122 A * 11/1978 Emmitt ..... 211/74
4,787,523 A * 11/1988 Kalous ..... 211/74
6,065,617 A * 5/2000 Cohen et al. ..... 211/74
7,282,182 B2 * 10/2007 Dale et al. ..... 422/562
2003/0215365 A1 * 11/2003 Sevigny et al. ..... 422/64

* cited by examiner

*Primary Examiner* — In Suk Bullock
*Assistant Examiner* — Paul Hyun
(74) *Attorney, Agent, or Firm* — McDermott Will & Emery LLP

(57) ABSTRACT

A rack for a plurality of capped tubes, including a frame having a longitudinally extending bottom base member having a row of spaced open top recesses adapted to receive the capped tubes. Vertical supports at the ends of the row of recesses fix a cover member above the base member. The cover member has openings therethrough smaller than the capped tubes. A wall is along one longitudinal side between the base member and the cover member, with the other longitudinal side between the base member and the cover member being open. Support fingers extend horizontally from the wall toward the open longitudinal side and are vertically aligned between the recesses to secure capped tubes in a generally vertical direction in a longitudinally extending vertical plane. The base member and cover member are vertically spaced a distance sufficient to permit tipped capped tubes to be moved into the frame with the tipped tubes then dropped into the recesses and tipped back to an upright vertical position.

12 Claims, 5 Drawing Sheets

106
118
134
114
8
144
138
136
130
104
140

SPECIMEN SAMPLE RACK

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to specimen testing, and more particularly toward a rack for supporting specimen containers in an automated specimen testing device.

BACKGROUND OF THE INVENTION AND TECHNICAL PROBLEMS POSED BY THE PRIOR ART

Automated specimen testing devices are widely used, for example, to test biological samples such as blood for medical purposes. In many such devices, efficient and cost effective testing requires that multiple specimen containers (e.g., test tubes) often be handled together for individual testing of the various specimens in the various containers.

In such automated devices, a plurality of containers are often placed in an array on an input deck. In some devices, the containers are themselves transported from the input deck to another part of the device for testing or other processing. In other devices, the containers may be positioned placed on the deck and then parts of the specimens may be automatically transported from the containers to other areas or containers of the device, for example by drawings parts of the specimens out of the containers by use of pipettes inserted into the containers and then transporting the pipettes to the other area or containers where the pipettes discharge the drawn specimens.

One such prior art structure which has allowed the specimen containers to be placed on the input deck with the specimens drawn out by pipettes is illustrated in FIG. 1. Specifically, a closed housing 10 secured to the deck 12 includes a pair of side walls 14 supporting a cover member 16 with an array of holes 18 therein. A plurality of open topped racks 20 are suitably secured to the deck 12, each rack 20 being longitudinal and defining a row of cylindrical openings 22 for supporting a row of containers or tubes 24 having specimens therein for testing or otherwise processing on the device. Each rack 20 may be secured in a position on the deck 12 in any suitable manner, such as a dovetailed groove 26 on the bottom which cooperates with a similar dovetailed projection from the deck 12, whereby a user can grasp a rack 20 by its projecting grip 28 on the end and slide the rack 20 into a position under the housing 10. Pipettes are thereafter moved down through the holes 18 in the cover member 16 and into the containers 24 to draw out desired amounts of the specimens contained therein.

In order to protect against contamination, the containers 24 may include covers over their top with pierceable membranes (e.g., elastic membranes) so that the pipettes may pierce the membranes to enter the containers 24 for access to the specimens contained therein, with the membranes substantially closing after the pipettes are removed, thereby both protecting the remaining specimens against external contamination and ensuring that nothing from the containers 24 escape to contaminate other specimens. The cover member 16 of the housing 12 helps to ensure that when the pipettes are retracted back up after accessing the specimens, the containers 24 will be retained in their rack 20 without being pulled up with the pipettes (if the pipettes get stuck in the membranes).

However, the above described structure has a plurality of disadvantages. If a rack 20 is not properly located on the deck 12, it may not be properly aligned with the array of openings 18. Thus, a pipette which is moved down through specific openings may not be aligned properly with the container 24 opening and could instead collide with and damage the container 24. Further, it should be appreciated that the housing 10 effectively restricts or even blocks access to many containers 24, particularly those containers 24 located in the middle of the array. Such access may be required, for example, to optically read labels on the containers to identify each container 24 having specific specimens. Of course, automatic operation requires that the device be able to identify containers so that the device may automatically conduct appropriate tests on those specific specimens requiring such tests.

Another prior art structure which has been used for similar purposes has included a rack which has an array of multiple rows (for example, twelve rows of eight), with corner posts on which a cover member may be removably mounted. With this rack, a plurality of containers may be placed in the array of openings in the rack and then the cover member is secured over the containers by bolt and nut or screw type connections to the corner posts at the corners of the cover member.

While this rack will reasonably reliably ensure that the array of openings in the cover member will be aligned with the containers therebeneath, it will particularly restrict or even block access to many containers (particularly those containers 24 located in the middle of the array) such as required to optically read labels on the containers. Further, it occupies the entire array on the device deck, and thus may either require that some tests be undesirably delayed (waiting on additional specimens requiring testing to fill up the rack before placing the rack on the device deck) or require inefficient use of the device (by mounting a rack occupying an entire array of container positions with only a few specimen containing containers). Moreover, if it is desired to add or remove any container after the rack is mounted on the device deck, it is required that the cover member be removed and, during that time, pipettes may not be used to get specimens from any containers in the rack as none of the containers will be covered so as to prevent them from sticking on the pipettes and being undesirably carried from the rack when the pipettes retract. Of course, securing the cover member over the rack, and removing the cover member from the rack, itself takes time which can result in inefficient use of the device which may have to sit idle waiting for that to be completed before starting the pipetting and/or container identification processes.

The present invention is directed toward overcoming one or more of the problems set forth above.

SUMMARY OF THE INVENTION

In one aspect of the present invention, a rack for a plurality of capped tubes is provided. The rack has a frame having a longitudinally extending bottom base member having a row of spaced open top recesses, with each of the recesses adapted to receive one of the capped tubes. Vertical supports are at the ends of the row of recesses and fix a cover member above the base member. The cover member has openings therethrough smaller than the capped tubes. A wall is along one longitudinal side between the base member and the cover member, with the other longitudinal side between the base member and the cover member being open. Support fingers extend horizontally from the wall toward the open longitudinal side and are vertically aligned between the recesses to secure capped tubes in a generally vertical direction in a longitudinally extending vertical plane. The base member and cover member are vertically spaced a distance sufficient to permit tipped capped tubes to be moved into the frame with the tipped tubes then dropped into the recesses and tipped back to an upright vertical position.

In one form of this aspect of the present invention, there is at least one opening in the side wall aligned with each of the recesses.

In another form of this aspect of the present invention, the top member includes a handle extending beyond one of the supports.

In yet another form of this aspect of the present invention, the base member includes a bottom slot adapted to receive a mounting member on a specimen testing device for securing the rack to a deck of the device.

In still another form of this aspect of the present invention, the recesses have a shape and depth sufficient to support a capped tube therein in an upright vertical position.

In another aspect of the present invention, a rack for a plurality of capped tubes is provided. The rack has a frame having a longitudinally extending bottom base member having a row of spaced open top recesses, each of the recesses being adapted to receive one of the capped tubes. Vertical supports are at the ends of the row of recesses, and a cover member is fixed by the supports above the base member by a distance X. The cover member has openings therethrough smaller than the capped tubes. The recesses are sized to receive a tube moved therein at an angle θ from vertical, where the capped tubes have a height no greater than about X when tilted at an angle θ from vertical.

In one form of this aspect of the present invention, a wall is along one longitudinal side between the base member and the cover member, wherein the other longitudinal side between the base member and the cover member is open. In a further form, there is at least one opening in the side wall aligned with each of the recesses. In another further form, support fingers extend horizontally from the wall toward the open longitudinal side, where the support fingers are vertically aligned between the recesses to secure capped tubes in a generally vertical direction in a longitudinally extending vertical plane.

In another form of this aspect of the present invention, the top member includes a handle extending beyond one of the supports.

In yet another form of this aspect of the present invention, the base member includes a bottom slot adapted to receive a mounting member on a specimen testing device for securing the rack to a deck of the device.

In still another form of this aspect of the present invention, the recesses have a shape and depth sufficient to support a capped tube therein in an upright vertical position.

BRIEF DESCRIPTION OF THE DRAWINGS

FIGS. 3-11 are views of components of the FIG. 2 rack, wherein:

FIG. 3 is a perspective view of the base portion of the rack,

FIG. 4 is a front face view of the base portion of FIG. 3,

FIG. 5 is an end view of the base portion of FIG. 3, the end being the left end of the FIG. 4 view, FIG. 6 is a top view of the base portion of FIG. 3, FIG. 7 is a bottom view of the base portion of FIG. 3, FIG. 8 is a cross-sectional view of the base portion taken along line 8-8 of FIG. 6, FIG. 9 is an enlarged detailed view of the right end of FIG. 6, FIG. 10 is an enlarged detailed view of the bottom of FIG. 5, FIG. 11 is an enlarged detailed view of the right end of FIG. 7 of the base portion;

DETAILED DESCRIPTION OF THE INVENTION

FIGS. 2-12 illustrate a specimen sample rack 100 in accordance with the present invention.

Figure 12:
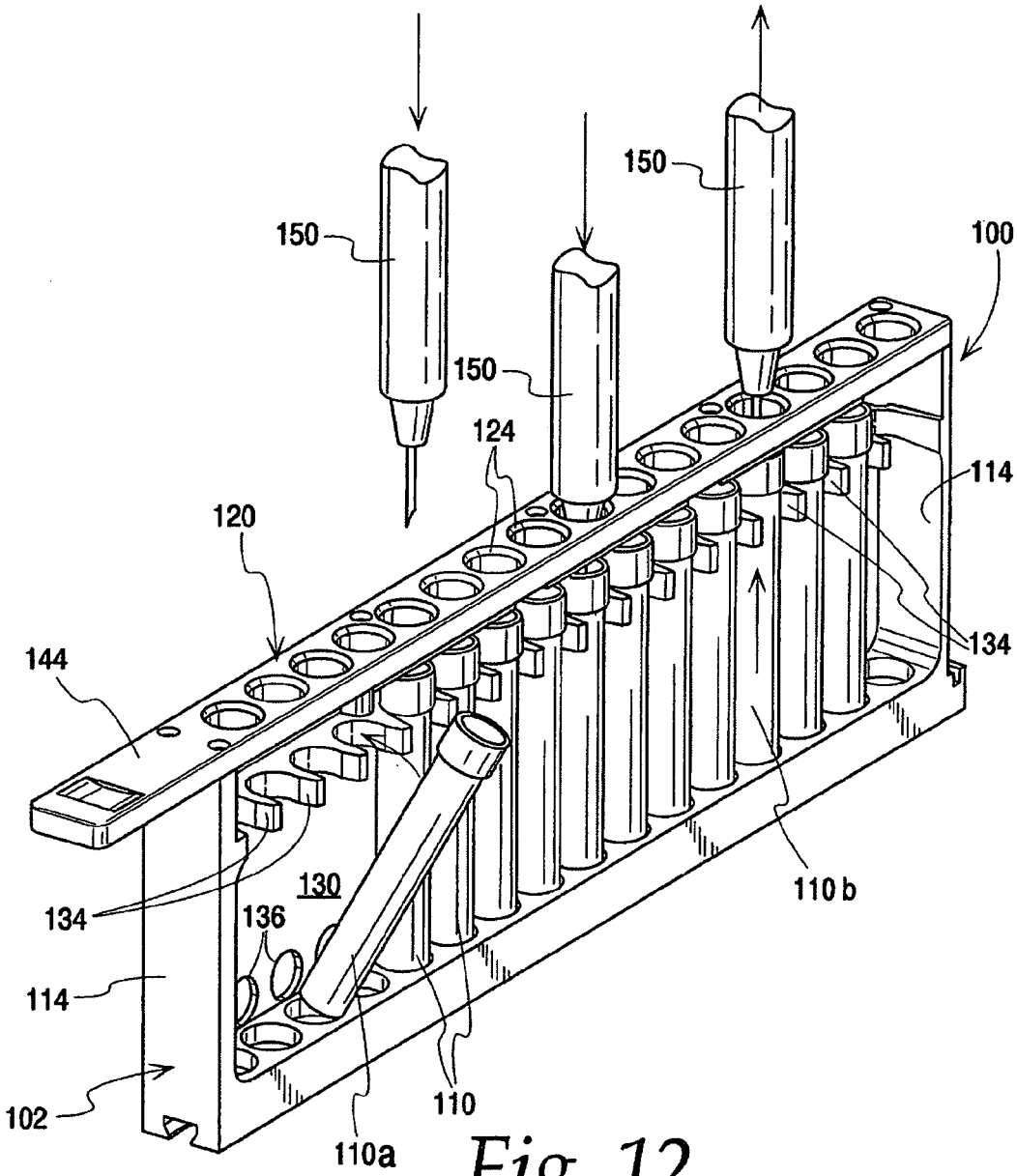
FIG. 12 is a perspective view of the specimen sample rack as may be used with containers and pipettes.

Specifically, the rack includes a frame 102 having a longitudinally extending bottom base member 104 which has a row of spaced open top recesses 106 adapted to receive capped containers or tubes 110 (see FIG. 12). Vertical supports 114 at the ends of the row of recesses 106 fix a top or cover member 120 above the base member 104. Intermediate supports 118 are also provided to ensure that the cover member is maintained in its supported position substantially parallel to the base member 104. It should be appreciated that the cover member 120 may be permanently fixed to the supports 114, 118 if desired, as normal operation as described below will not require removal of the cover.

The cover member 120 has openings 124 therethrough smaller than the capped tubes 110 so that the capped tubes 110 cannot fit through the openings 124.

A wall 130 is along one longitudinal side between the base member 104 and the cover member 120. The other longitudinal side between the base member 104 and the cover member 120 is open.

Support fingers 134 extend horizontally from the wall 130 toward the open longitudinal side and are vertically aligned between the recesses 106. As a result, as shown in FIG. 12 and as further described below, capped tubes 110 may be secured in a generally vertical direction in a vertical plane extending longitudinally in the direction of the base member 104.

Openings 136 are provided in the side wall 130 aligned with each of the base member recesses 106. These openings 136 allow for optical scanners to readily detect, from behind the wall 130, whether or not a tube 110 is present in each of the various tube positions defined by the recesses 106. The open side of the frame 102 also permits easy access for optical reading of labels on any tubes 110 which may extend along the tube 110 more than the height of the openings 136.

Figure 1:
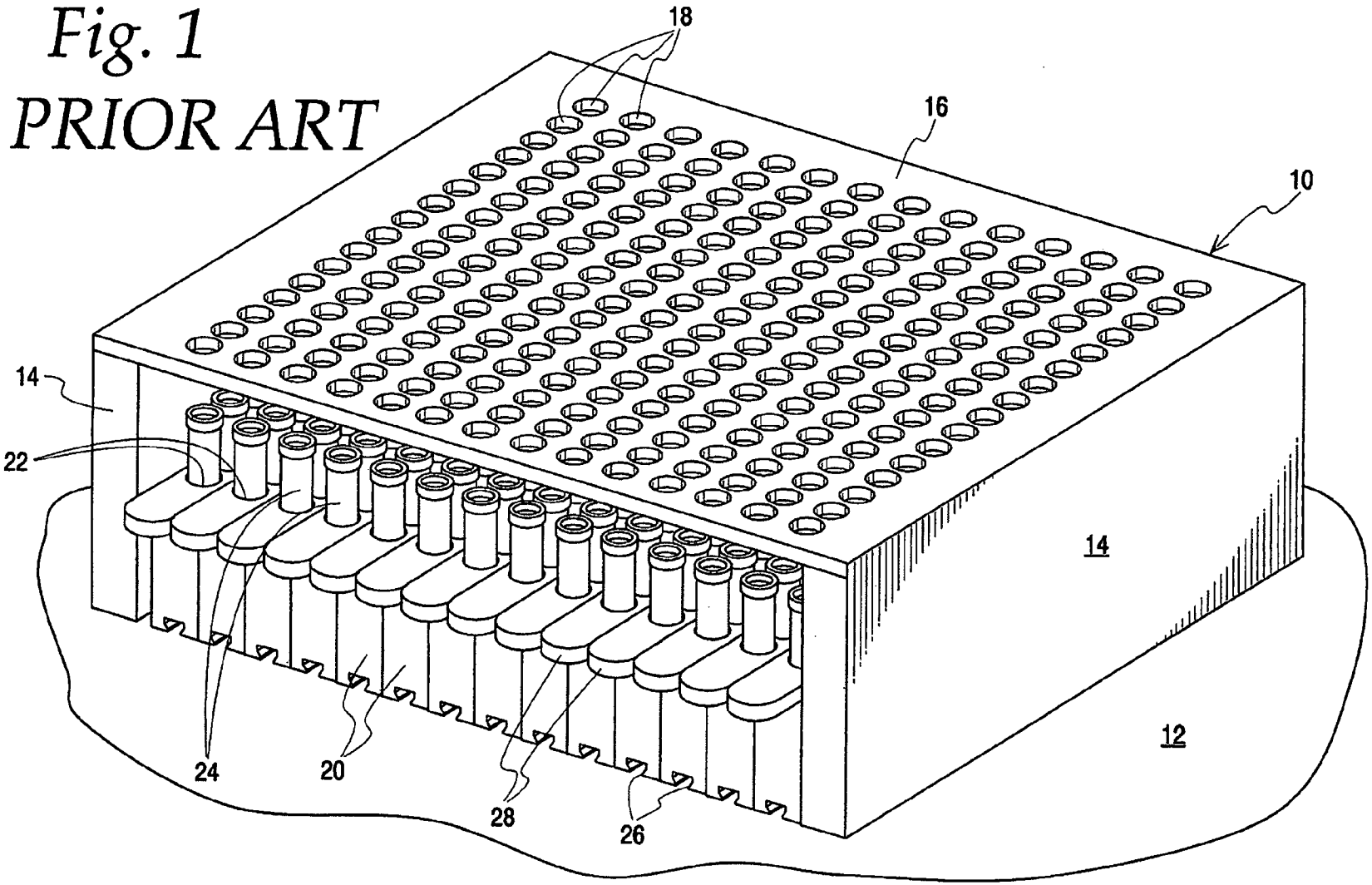
Fig. 1 PRIOR ART
FIG. 1 is a perspective view of a prior art rack for specimen sample containers.
Figure 2:
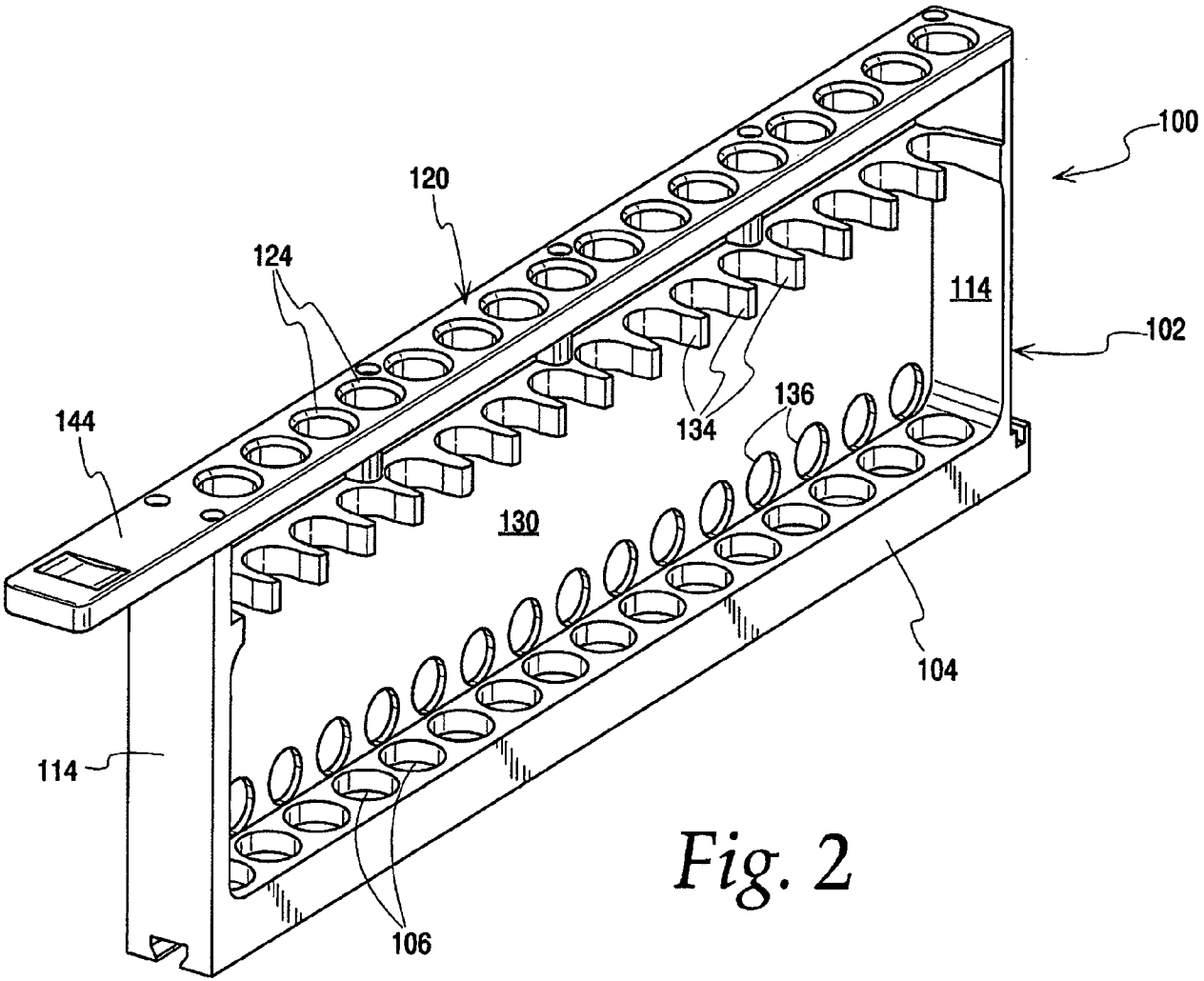
FIG. 2 is a perspective view of a specimen sample rack according to the present invention.
Figures 3, 4, 5, 6, 7, 8, 9, 10, 11:
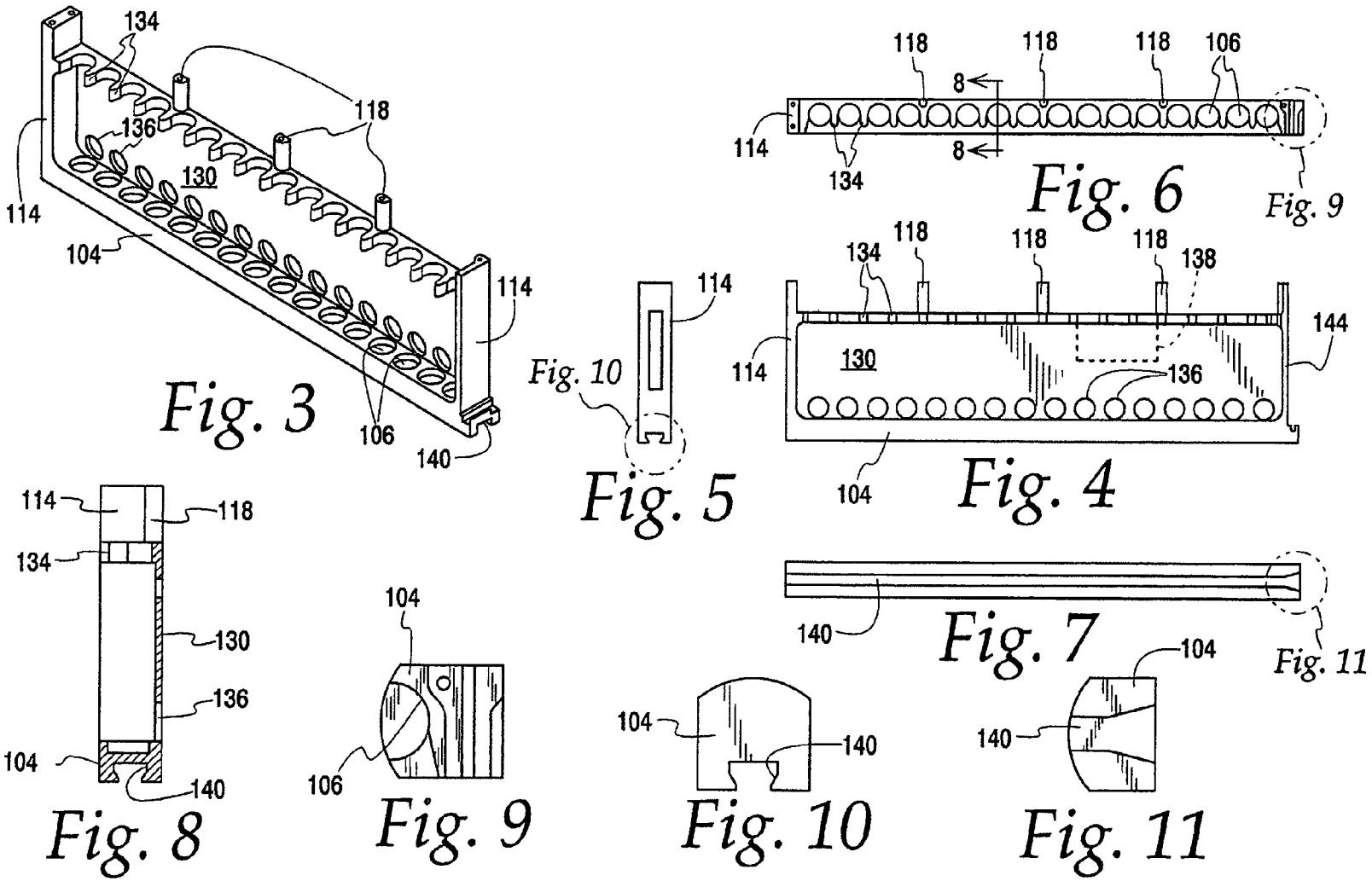

In addition, slots may be provided in the wall 130 (one such slot 138 is shown in phantom in FIG. 6 associated with three base member recesses 106). Such slots 138 provide access to the tubes 110 to enable the tube tops to be pushed to facilitate tipping the tubes 110 out away from the wall 130 for removal.

The base member 104 also includes a suitable structure allowing the rack 100 to be readily mounted on a deck of a testing device or machine. Specifically, as illustrated particularly in FIGS. 7, 10 and 11, a dovetailed groove 140 extends along the bottom of the base member 104 and is adapted to receive a similar dovetailed projection from the device deck. Further, the groove 140 at the forward end (the right end in FIGS. 2-4) of the rack 100 is flared outwardly (see FIG. 11) to facilitate mounting by sliding the rack 100 longitudinally onto projections on the deck. The cover member 120 includes a handle 144 which extends beyond the vertical support 114 at the rear of the rack 100. A user can assemble capped tubes 110 in the rack 100 on a benchtop and then, grasping the handle 144, carry the rack to the device and slide the rack 100 longitudinally onto the deck, with the flared forward end of the groove 140 facilitating such mounting by helping to guide the projections into the groove 140 as the rack 100 is slid over them. Of course, it should be appreciated that the deck projections could be a plurality of longitudinally aligned and spaced dovetail projections, or could consist of a single longitudinally aligned dovetailed rail. Moreover, still other types of connection between the rack and the deck could be used while advantageously using other aspects of the invention.

In accordance with one aspect of the present invention, the base member 104 and cover member 120 are vertically spaced a distance sufficient to permit tipped capped tubes (see tube 110*a* in FIG. 12) to be moved into the frame 102 with the tipped tubes then dropped into the recesses 106 and tipped back to an upright vertical position. For example, the cover member 120 may be spaced above the base member 104 by a distance X, with the recesses 106 sized to receive a tube 110 moved therein at an angle θ from vertical, where the capped tubes 110 have a height no greater than about X when tilted at an angle θ from vertical.

Figure 13:
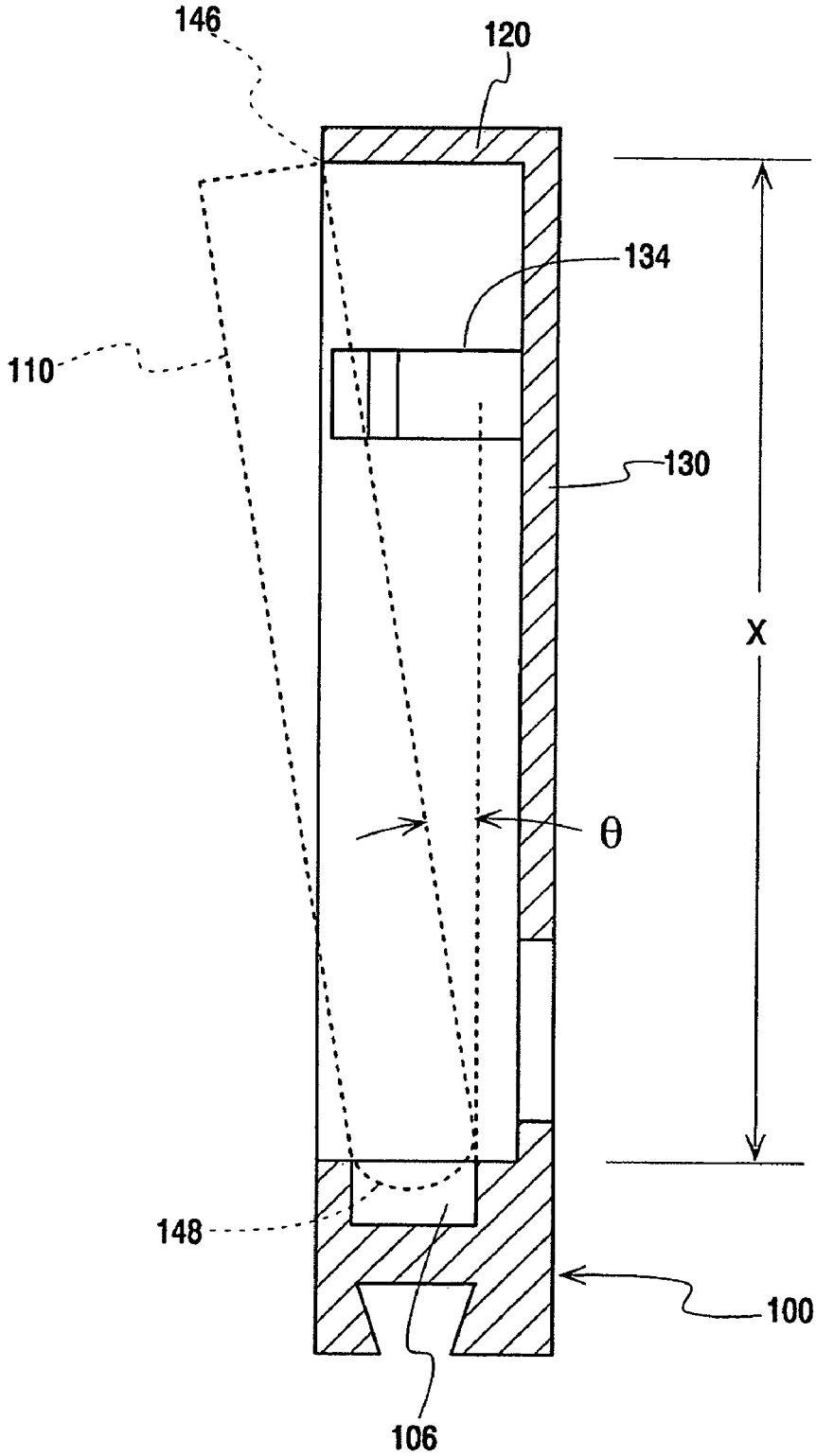
FIG. 13 is a simplified cross-sectional view similar to FIG. 8, illustrating the rack with the cover member with a tube being moved into the rack shown in phantom.

Specifically, as illustrated in FIG. 13, it should be appreciated that a tube 110 which is too tall to fit into the rack would hit the cover member 120 when it has its lower end aligned with a base member recess 106 when it is at an angle θ from vertical. That angle θ can be characterized as the minimum tilt angle, in that it is the smallest angle which a tube of maximum acceptable height may be tipped during moving into the rack 100 before the uppermost corner 146 (see FIG. 13) of the tipped tube 110 will move under the cover member 120 (or the upper end of a tube which is too tall would hit the cover member 120). The maximum tube height when tilted the angle θ is thus the height from the bottom-most part 148 of the tube 110 to the uppermost corner 146, which includes a small amount allowing for any curvature of the bottom of the tube 110 which may begin to extend slightly into the base member recess 106 even when axially misaligned from the recess 106 by the angle θ as illustrated in FIG. 13. The maximum tube height is thus X, or more precisely "about X" which includes the small allowance for curvature of the tube bottom 148 as mentioned above.

In addition to the spacing between the base member 104 and cover member 120 relative to the capped tube 110 height, the recesses 106 may be shaped so that in addition to tipping the tubes 110 upright, the bottoms of the tubes 110 may be able to move down into the recesses 106 as the tubes 110 are tipped upright and before the tops of the tubes 110 would interfere with the cover member 120. In that case, the capped tubes 110 might have a height even slightly greater than X when tilted at an angle θ from vertical.

Moreover, the recesses 106 may have a shape and depth sufficient to support a capped tube therein in an upright vertical position.

As a result of this configuration, the tubes 110 may be readily moved into the rack 100 notwithstanding the presence of the cover member 120 while such assembly occurs. Thus, the tubes 110 may all be assembled in the rack 100 without requiring that a user spend time removing and replacing such a cover, all while permitting operation whereby pipettes 150 (see FIG. 12) may be moved into the capped tubes 110 by piercing their caps with the cover member 120 still preventing the tubes 110 from being inadvertently pulled up out of the rack 110 should the pipette 150 stick in the pierced tube cap (see tube 110*b* in FIG. 12). Moreover, such operation is accomplished by use of one or more racks 100 which may be readily accessed in order to, for example, optically scan for the presence of tubes 110.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A rack for a plurality of capped tubes, comprising a frame having:

a longitudinally extending bottom base member having a row of spaced open top recesses, each of said recesses adapted to receive one of the capped tubes;

vertical supports at the ends of the row of recesses, said supports fixing a cover member above said base member, said cover member having openings therethrough adapted to prevent the capped tubes from passing through the openings;

a wall along one longitudinal side between said base member and said cover member, wherein another longitudinal side between said base member and said cover member is open; and support fingers extending horizontally from said wall toward said open longitudinal side to positions vertically aligned between said recesses to secure capped tubes received by the recesses through the open longitudinal side in a generally vertical direction in a longitudinally extending vertical plane;

wherein the base member and the cover member are vertically spaced a distance to permit capped tubes having a height greater than the distance between the base member and the cover member to be moved into the frame through the open longitudinal side by tipping the capped tubes, dropping the capped tubes into the open top recesses and tipping the capped tubes back to an upright vertical position so the capped tubes may be secured by the support fingers.

2. The rack of claim 1, further comprising at least one opening in said wall aligned with each of said recesses.

3. The rack of claim 1, wherein the cover member includes a handle extending beyond one of said supports.

4. The rack of claim 1, wherein said base member includes a bottom slot adapted to receive a mounting member on a specimen testing device for securing said rack to a deck of said device.

5. The rack of claim 1, wherein said recesses have a shape and depth sufficient to support a capped tube therein in an upright vertical position.

6. A rack for a plurality of capped tubes, comprising a frame having:

a longitudinally extending bottom base member having a row of spaced open top recesses, each of said recesses adapted to receive one of the capped tubes; and vertical supports at the ends of the row of recesses, said supports fixing a cover member above said base member by a distance X, said cover member having openings therethrough;

a wall between the base member and the cover member, the wall extending along one longitudinal side between the base member and cover member, wherein another longitudinal side between the base member and cover member is open; and support fingers extending from the wall to positions vertically aligned between the recesses, the support fingers adapted to secure capped tubes received by the recesses through the open longitudinal side in a generally vertical direction in a longitudinally extending vertical plane;

wherein the distance X permits capped tubes having a height greater than the distance X to be moved into the frame through the open longitudinal side by tipping the capped tubes, dropping the capped tubes into the open top recesses and tipping the capped tubes back to an upright vertical position so the capped tubes may be secured by the support fingers.

7. The rack of claim 6, further comprising at least one opening in said wall aligned with each of said recesses.

8. The rack of claim 6, wherein the support fingers extend horizontally from said wall toward said open longitudinal side.

9. The rack of claim 6, wherein the cover member includes a handle extending beyond one of said supports.

10. The rack of claim 6, wherein said base member includes a bottom slot adapted to receive a mounting member on a specimen testing device for securing said rack to a deck of said device.

11. The rack of claim 6, wherein said recesses have a shape and depth sufficient to support a capped tube therein in an upright vertical position.

12. The rack of claim 6, wherein said base member, cover member and recesses are sized to define a tube minimum tilt angle of θ from vertical, and said recesses are adapted to receive capped tubes having a height no greater than about X when tilted at said angle θ from vertical.

* * * * *